United States Patent [19]

Hasle et al.

[11] Patent Number: 4,793,739

[45] Date of Patent: Dec. 27, 1988

[54] OFFSHORE STRUCTURE

[75] Inventors: Alf E. Hasle, Slependen; Per C. Sandnaes, Oslo, both of Norway

[73] Assignee: Aker Engineering A/S, Oslo, Norway

[21] Appl. No.: 64,338

[22] Filed: Jun. 19, 1987

[30] Foreign Application Priority Data

Jul. 4, 1986 [NO] Norway ..... 862713

[51] Int. Cl.[4] ..... E02B 17/02

[52] U.S. Cl. ..... 405/227; 405/202

[58] Field of Search ..... 405/195, 202, 224, 227

[56] References Cited

U.S. PATENT DOCUMENTS

| | | | |
|---|---|---|---|
| 3,677,016 | 7/1972 | Garrigus | 405/202 |
| 4,273,470 | 6/1981 | Blomsma et al. | 405/202 |
| 4,363,567 | 12/1982 | Van Der Graaf | 405/195 |
| 4,378,179 | 3/1983 | Hasle | 405/227 |
| 4,431,344 | 2/1984 | Abbott et al. | 405/202 |
| 4,696,603 | 9/1987 | Danaczko et al. | 405/227 |

*Primary Examiner*—David H. Corbin

*Attorney, Agent, or Firm*—Hedman, Gibson, Costigan & Hoare

[57] ABSTRACT

A compliant concrete structure which is supported by using a compliant pile system consisting of piles and pile sleeves so that the platform may yield to large oscillations when the structure is installed in a body of water. The invention comprises attaching the pile sleeve guides (6) and the pile sleeves (3) to a rotation symmetrical concrete shell which forms the basic structure. The pile sleeves are rigidly connected to the lower end portion (2) of the structure.

7 Claims, 6 Drawing Sheets

OFFSHORE STRUCTURE

FIELD OF THE INVENTION

The present invention relates to a platform concept suitable for use in deep waters, and more specifically the invention relates to a concrete structure supported by a compliant pile system for securing its vertical weight and ability to withstand environmental forces when the structure is installed in a body of water.

BACKGROUND OF THE INVENTION

New offshore structures have recently been suggested for recovering hydrocarbons from marine sediments lying beneath very deep water. One such offshore structure is a rigidly based concrete platform consisting of one or more legs for supporting the deck structure. The environmental forces are transmitted to the sea floor through a strong bottom structure, which is some embodiments have deep skirts. It is characteristic for this type of foundation that the platform obtains a first oscillating period which is substantially shorter than the wave periods exciting the structure. The dynamic response caused by the environmental forces will therefore always be higher than the result of the static forces. In deep waters this type of structure will necessitate gigantic dimensions in order to withstand the environmental forces.

Existing and known structural solutions for concrete platforms fixed to the bottom entail making a large bottom structure with a plurality of cells, with or without deep skirts to be forced into the bottom of the sea in order to obtain the stiffest possible fixation. Alternatively it has been suggested to pile this type of structure to the bottom in order to increase the fixation and prevent foundation settlements. Calculations show that this may be obtained by means of a large number of piles, but that it would require a long installation time, which could be a potential problem if the weather window is short during this operation. It is commonly known among platform designers that this platform type becomes uneconomical at large ocean depths. Compliant steel platforms have recently been developed in order to alleviate the problems of the rigidly based structures, and the tendency is that this results in less costly solutions.

The present invention consists in using a compliant pile system for supporting a concrete structure so that the structure becomes compliant with respect to the wave forces, contrary to existing concrete platforms. The pile system is generally described in U.S. Pat. No. 4,378,179 issued Mar. 29, 1983, but as a foundation system for a guyed tower. For a compliant concrete platform the pile sleeve guides and the pile sleeves will be attached directly to the concrete shell. The main attachments of the pile sleeves to the concrete shell may be anywhere along the column and must be adapted in each particular case.

The advantages of using said invention is primarily low structural weight and short fabrication time, which has been made possible by the use of the compliant pile system. The total forces that the foundation system must absorb are substantially reduced as compared to a rigidly fixed platform.

BRIEF DESCRIPTION OF THE DRAWINGS

The invention will be described more closely with the aid of the exemplifying embodiments shown in the drawings, where like parts have been given like reference numerals. In the drawings.

DETAILED DESCRIPTION OF THE INVENTION

Figure 1:
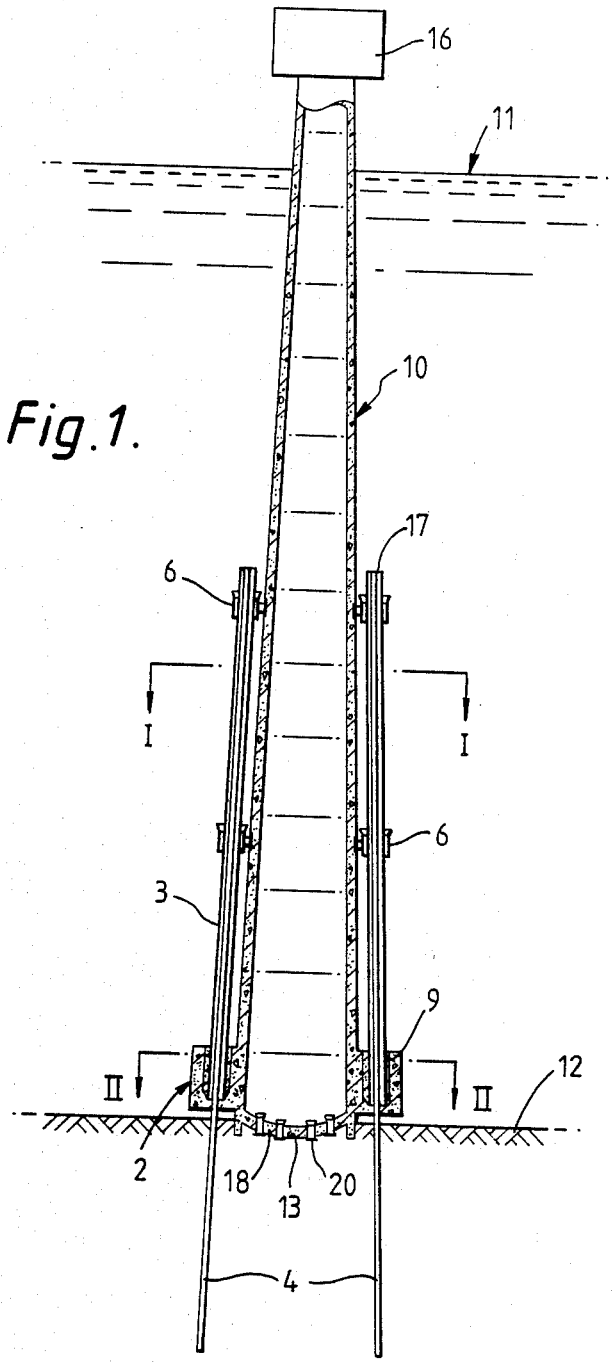
FIG. 1 shows a side view of a platform illustrating the arrangement of the structural elements.
Figure 2:
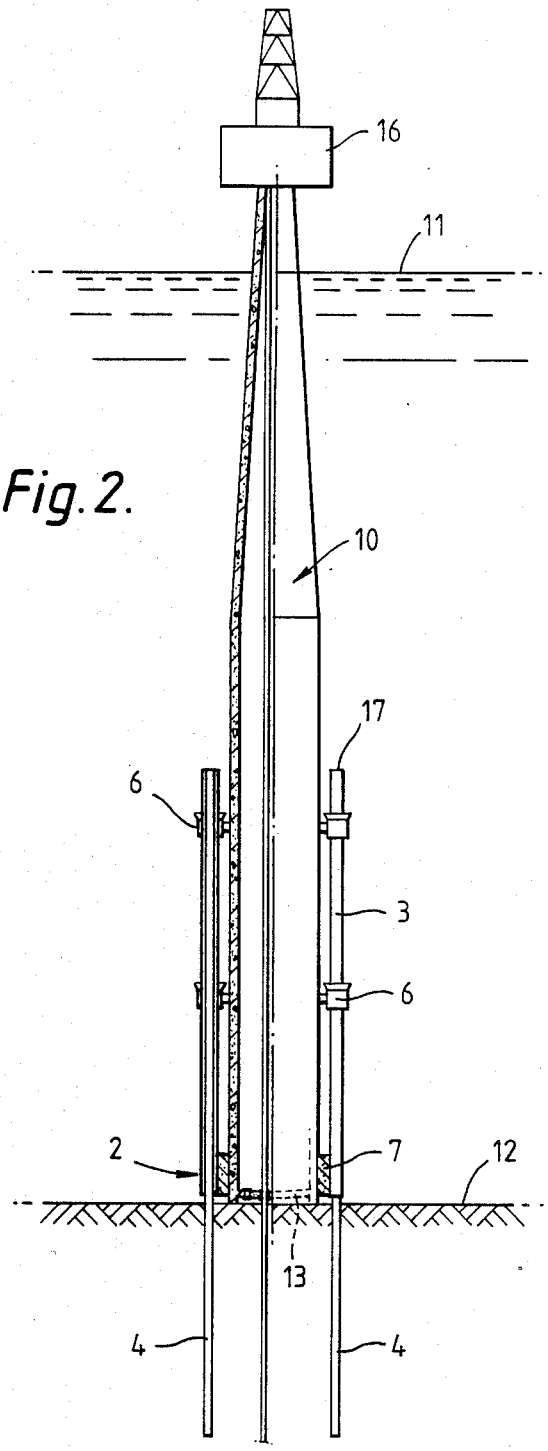
FIG. 2 shows a side view of another embodiment of the invention.
Figure 3:
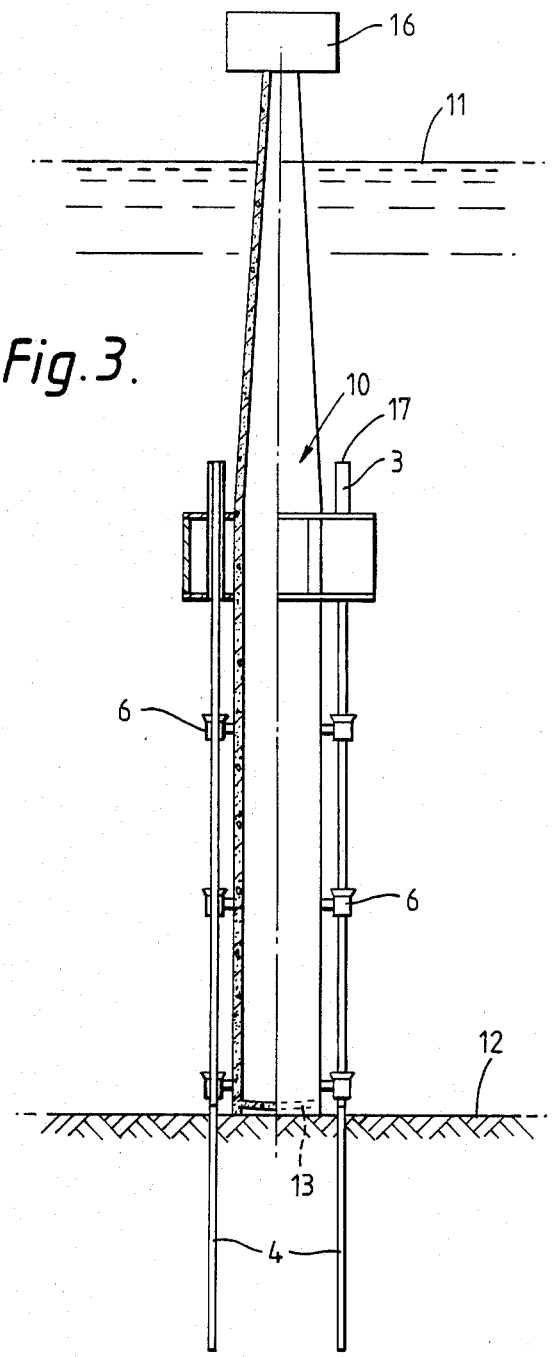
FIG. 3 shows a side view of another embodiment of the invention.
Figure 7:
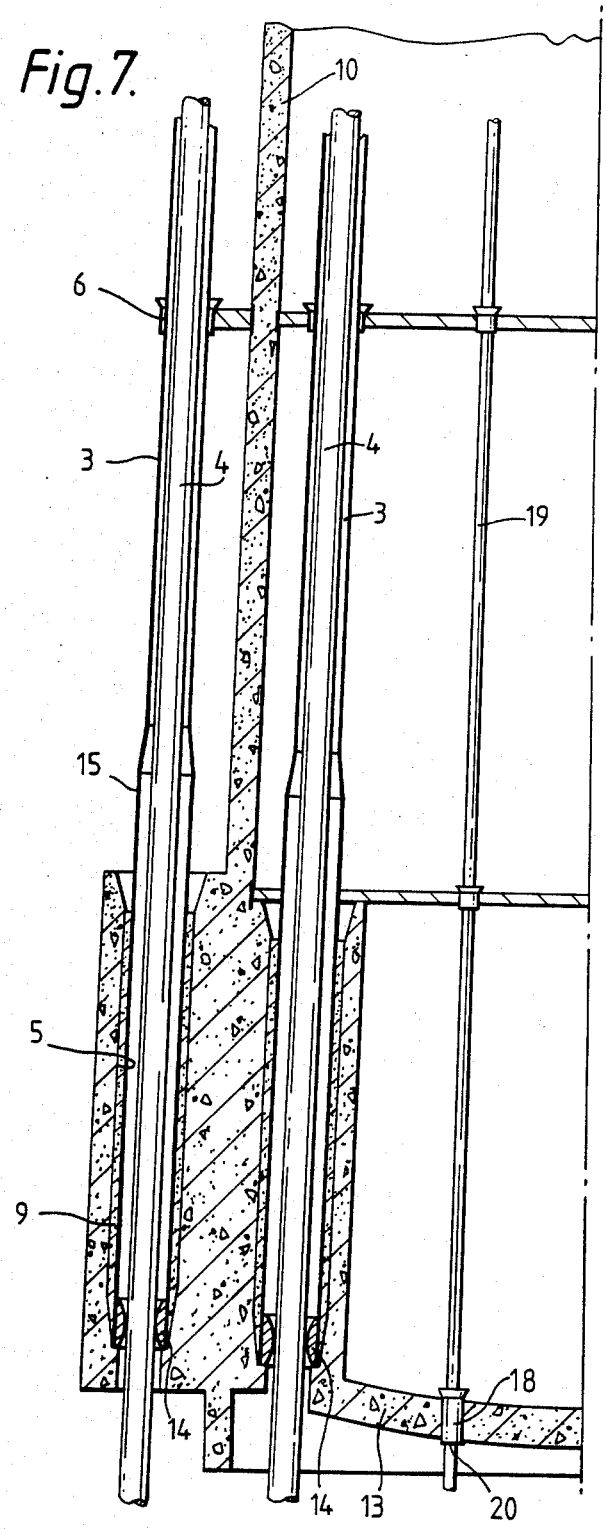
FIG. 7 shows the pile and pile sleeves on both sides of the concrete structure.

FIGS. 1, 2 and 3, show a concrete tower structure 10 installed in a body of water, the water surface being designated 11 and the sea floor 12. The figures show a section through the structure, which in reality is three dimensional. As illustrated, the structure comprises a number of structural elements, where the main tower 10 consists of a conical concrete pipe having a bottom plate 13 and pile sleeves 3 and piles 4 together forming a compliant structure, the piles 4 being rigidly connected to the pile sleeves 3 at the upper end point 17 which in turn is supported by pile sleeve guides 6 and the lower portion 15 of the pile sleeve 3 being rigidly connected to the lower end portion 2 of the concrete structure 10. The pile sleeves (3) and piles (4) may be outside the concrete structure or inside or both as seen in FIG. 7.

The deck 16 is mounted on the upper end of the tower 10 and is used to perform drilling and production operations through the tower 10.

In structures of known type the foundation will normally consist of deep concrete skirts or driven piles which are grouted to the lower end portion 2 of the structure.

Figure 6:
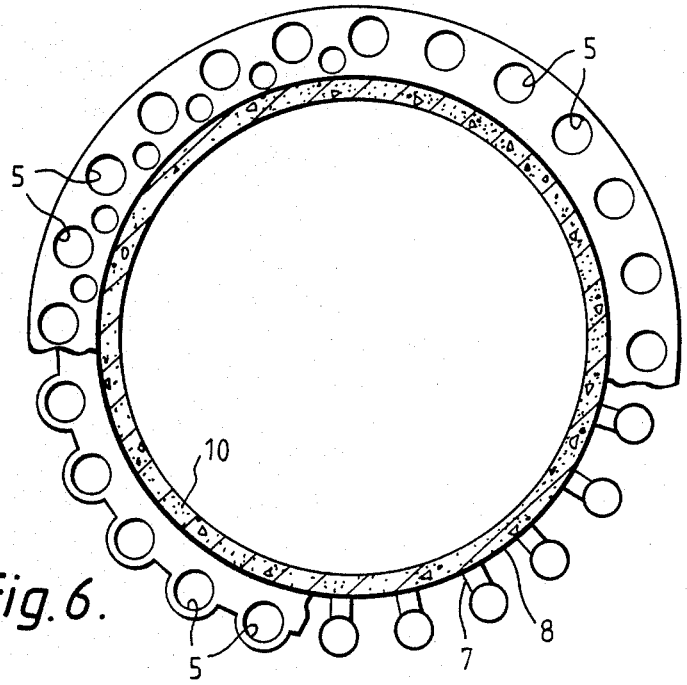
FIG. 6 shows a section through the structure along the line II—II in FIG. 1.

The present invention entails the use of a compliant pile system consisting of piles 4 and pile sleeves 3 which are rigidly connected to the lower end portion 2 of the structure. The lower portion 15 of the pile sleeve 3 may be provided with a somewhat larger diameter in the attachment area than the upper portion of the pile sleeve 3, so that the stress level is reduced correspondingly during the fixation. In such an embodiment the pile 4 may be deformed by bending inside the lower portion pile sleeve 15 of the 4. The pile sleeves 3 and are attached to the lower end portion 2 of the concrete structure by being inserted into recesses 5 and grouted to the concrete structure 10 in the area designated by numeral 9. The recesses 5 are made with a varying diameter so that the pile sleeves 3 are guided towards the desired abutment surface 14 during the installation. The recess 5 itself can be made of steel and remain permanently in the structure after casting, and in that case the abutment surface 14 will be a solid steel plate having a hole for the pile 4. The pile sleeves 3 may also be welded directly to shear panels 7 (see FIG. 2) if the lower end portion 2 is made with a strong steel cladding 8 (see FIG. 6) on the outside.

In the figures the pile sleeves 3 are shown terminated at the water surface 11, but in several applications it may be advantageous to terminate these above the water surface 11.

Figure 4:
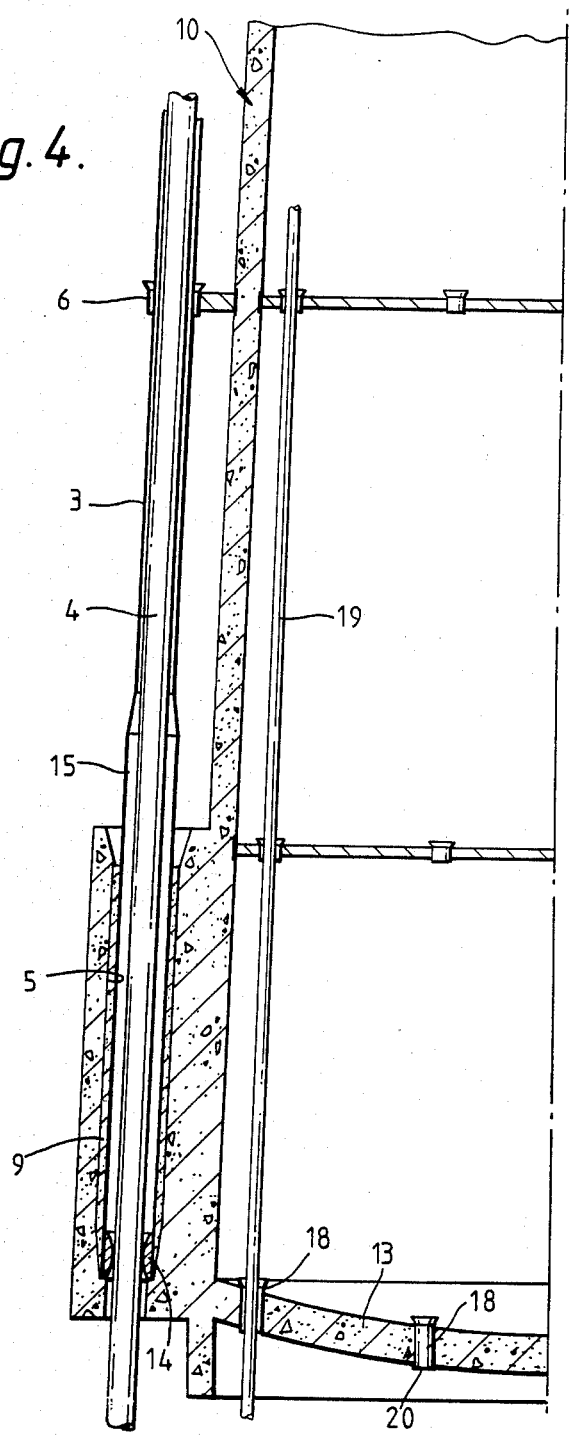
FIG. 4 shows the attachment of pile sleeves in the lower end portion.
Figure 5:
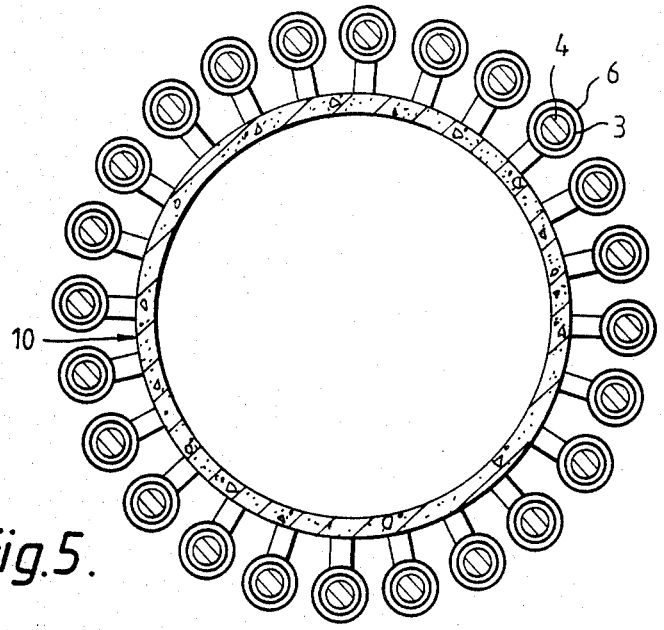
FIG. 5 shows a section through the structure along line I—I in FIG. 1.

The bottom plate 13 should be watertight during the fabrication process since this will take place floating vertically. Pipe sleeves 18, which later will be supporting sleeves for riser pipes 19, are cast into the bottom structure 13 and are a part of the latter. The pipe sleeves 18 are sealed with a sealing stopper 20, which is to be removed after the tower has been finally installed (see FIG. 4).

The function of the pile system is primarily to provide stability for the structure and support it vertically, secondly to give the platform a natural sway period which is substantially longer than the period of the largest wave the platform is designed for, thus reducing the total forces transmitted to the foundation system. This is obtained by using the pile system as described.

We claim:

1. A compliant offshore concrete structure extending from the sea floor to above the water surface, characterized in that the concrete structure (10) comprises a single rotation symmetrical shell provided with a watertight, pressure resistant bottom structure (13) having integrated, temporarily sealed pipe sleeves (18) and being vertically supported by a compliant pile system comprising pile sleeves (3) rigidly connected to the concrete structure (10) at a lower end portion (2), and piles (4) mounted within the pile sleeves (3) and attached to the pile sleeves (3) at an upper end portion (17), wherein the compliant pile system is adapted to yield to the swaying movements of the concrete structure without losing strength, and said concrete structure having a natural oscillation period greater than the natural oscillation period of the water with which it is in contact.

2. The compliant concrete structure according to claim 1, characterized in that the pile sleeves (3) have a lower portion (15), wherein the lower end portion (2) of the concrete structure (10) has a plurality of recesses (5) for receiving the lower portion (15) of the pile sleeves (3).

3. The compliant concrete structue according to claim 1, wherein the lower end portion (2) of the concrete structure (10) further comprises steel cladding (8) and shear panels (7) affixed to the steel cladding (8), said pile sleeves (3) being rigidly affixed to the shear panels (7).

4. The compliant concrete structure according to claim 2, wherein the lower portion (15) of the pile sleeves (3) have a diameter greater than the diameter of the upper portion of the pile sleeves (3).

5. The compliant concrete structure according to claim 1 characterized in that the pile sleeves (3) are placed both on the inside and the outside of the concrete shell (10).

6. The compliant concrete structure according to claim 2 characterized in that the pile sleeves (3) are placed both on the inside and the outside of the concrete shell (10).

7. The compliant concrete structure according to claim 3 characterized in that the pile sleeves (3) are placed both on the inside and the outside of the concrete shell (10).

* * * * *